United States Patent [19]

Amano

[11] Patent Number: 5,054,585

[45] Date of Patent: Oct. 8, 1991

[54] ELEVATOR CONTROL APPARATUS

[75] Inventor: Masaaki Amano, Inazawa, Japan

[73] Assignee: Mitsubishi Denki Kabushiki Kaisha, Japan

[21] Appl. No.: 416,598

[22] Filed: Oct. 3, 1989

[30] Foreign Application Priority Data

Oct. 25, 1988 [JP] Japan ..... 63-267191

[51] Int. Cl.[5] ..... B66B 1/18

[52] U.S. Cl. ..... 187/124

[58] Field of Search ..... 187/124, 127

[56] References Cited

U.S. PATENT DOCUMENTS

| | | | |
|---|---|---|---|
| 4,669,579 | 6/1987 | Ookubo | 187/124 |
| 4,672,531 | 6/1987 | Uetani | 364/138 |
| 4,760,896 | 8/1988 | Yamaguchi | 187/124 |
| 4,802,082 | 1/1989 | Uetani | 364/138 |

FOREIGN PATENT DOCUMENTS

| | | |
|---|---|---|
| 60-209475 | 10/1985 | Japan . |
| 63-87484 | 4/1988 | Japan . |

*Primary Examiner*—A. D. Pellinen
*Assistant Examiner*—W. E. Duncanson, Jr.
*Attorney, Agent, or Firm*—Leydig, Voit & Mayer

[57] ABSTRACT

An elevator control apparatus for moving free elevator cages to optimal stand-by floors determined according to a plurality of fuzzy rules of if-then format. A learning function is employed for altering the parameters of the fuzzy rules based on statistics of past traffic patterns over a pre-determined time period. Free elevator cages are detected by an operation control element and then moved to optimal stand-by floors. A stand-by control element responsive to fuzzy rules generates a signal directed to the operation control element for initiating movement of the free elevator cages.

3 Claims, 6 Drawing Sheets

ELEVATOR CONTROL APPARATUS

BACKGROUND OF THE INVENTION

The present invention relates to an elevator control apparatus for managing a plurality of elevator cages in a group and, more particularly, to an elevator control apparatus for moving a free cage to an optimum stand-by floor at the time when a cage is free.

Recently, in an elevator control apparatus for group supervising a plurality of elevator cages, a microcomputer is employed to process a large amount of information and arithmetic operations, thereby realizing a precise control.

Generally, an elevator cage pauses at a floor after the cage responds to the final call, and enters a stand-by state until a hall call is then assigned to the cage, thereby becoming a free cage. Such a free cage usually occurs in an ordinary time zone which is not congested. However, it is not always effective for the free cage to stand by at the final respons floor as it is.

Therefore, when all the elevator cages become free and a predetermined time is then elapsed in a prior-art elevator control apparatus, a method of dispersively standing by the respective cages at predetermined floors is employed.

There is also considered a method of determining effective stand-by floors for the free elevator cages in accordance with learned data as disclosed in Japanese Laid-open Patent Application No. 60-209475. In this case, the stand-by floors are determined as floors having higher priority order of many traffic demands on the basis of main floor, upper floor or learning result.

However, although passenger demand can be predicted to a certain degree from a learning result, the congestion of the passengers does not always become as predicted. Since an accidental congestion of passengers cannot be predicted, the timing of determining stand-by floors or generating a stand-by command is not always optimum under the circumstances of all the time points.

Since free elevator cages are kept standing by according to preset conditions as described above in the prior-art elevator control apparatus, there arise problems that the free cages cannot be moved to optimum stand-by floors under the traffic state varying from time to time.

SUMMARY OF THE INVENTION

The present invention has been made to eliminate the above-described problems and has for its object to provide an elevator control apparatus which can freely move an elevator cage or cages to an optimum floor or floors during the free-time.

An elevator control apparatus according to the present invention comprises operation control means for detecting a free elevator cage and suitably moving the free cage, a fuzzy rule base for storing a plurality of fuzzy rules of IF-THEN format written with conditions necessary to move the free cage and executing procedure, learning means for altering the parameters of said fuzzy rules on the basis of information from said operation control means, and stand-by control means for calculating fuzzy amounts of the fuzzy rules for the stand-by state of the free cage and selecting a fuzzy rule that the fuzzy amount exceeds maximum and lower limiting value.

In the present invention, even if one free elevator cage occurs, the service state of the elevator cages at that time is represented as a fuzzy amount, a fuzzy rule most adequate for the service state is selected by means of fuzzy inference, and the free cage is moved to the optimum stand-by floor at that time.

BRIEF DESCRIPTION OF THE DRAWINGS

In the drawings, the same symbols indicate identical or corresponding portions.

DESCRIPTION OF THE PREFERRED EMBODIMENTS

Figure 1:
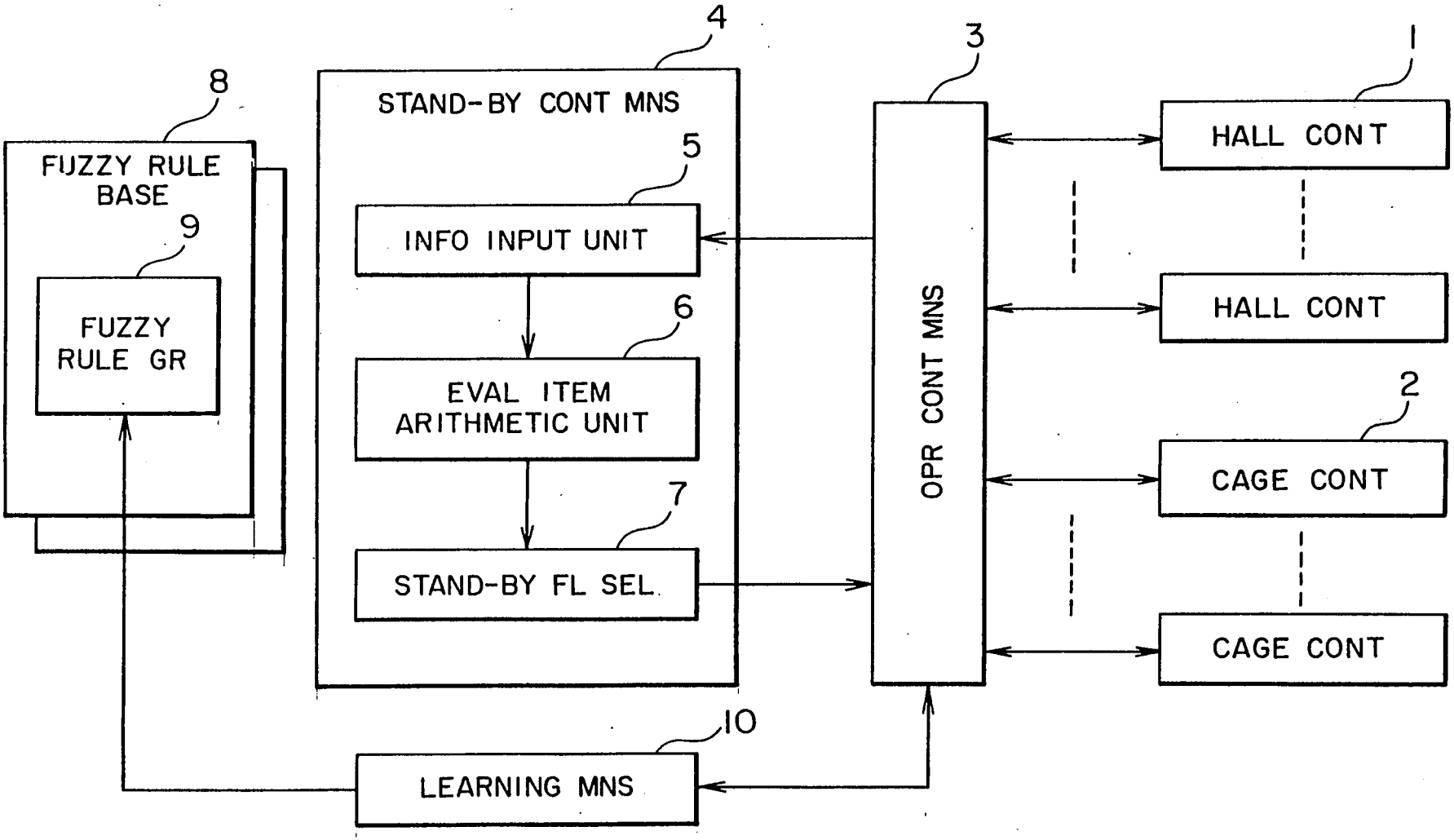
FIG. 1 is a block diagram showing an embodiment of an elevator control apparatus according to the present invention.

An embodiment of the present invention will be described in detail with reference to the accompanying drawings. FIG. 1 is a block diagram showing an embodiment of the present invention. A hall controller 1 for outputting a hall call is provided in the hall at each floor, and an elevator cage controller 2 for outputting a cage call is provided in each elevator cage.

Operation control means 3 for controlling to move elevator cages on the basis of information of hall calls and cage calls or the like stores an evaluation function for assigning the elevator cage or cages to the hall call or calls.

Stand-by control means 4 for communicating information with the operation control means 3 comprises an information input unit 5 for confirming the occurrence of a free elevator cage, an evaluation item arithmetic unit 6 for calculating the evaluation item of the stand-by state of the free elevator cage, and a stand-by floor selector 7 for selecting the stand-by floor of the free cage on the basis of the calculated result of the evaluation item arithmetic unit 6, and for determining an optimum stand-by floor when a free cage occurs.

A plurality of fuzzy rule bases 8 for selecting a stand-by operation are provided as required, and respectively store a plurality of fuzzy rules of IF-THEN format written with conditions necessary to move a free elevator cage or cages and an executing procedure, i.e., a fuzzy rule group 9. The fuzzy rule base 8 stores a plurality of membership functions to be described in detail later, to be used for the IF section (condition section) of each fuzzy rule.

Learning means 10 learns the traffic demand of each hall as statistic data from the information obtained from the operation control means 3, and has functions of altering various parameters of the evaluation function in the operation control means 3 and the membership function in the fuzzy rule base 8.

The operation control means 3, the stand-by control means 4 and the learning means 10 described above store predetermined programs and routines, respectively, and are so coupled to each other as to transmit, for example, information on on-line real time basis.

Next, the operation of the embodiment of the present invention shown in FIG. 1 will be described by referring to the explanatory view of FIG. 2 and the flow chart of FIG. 3.

Figure 2:
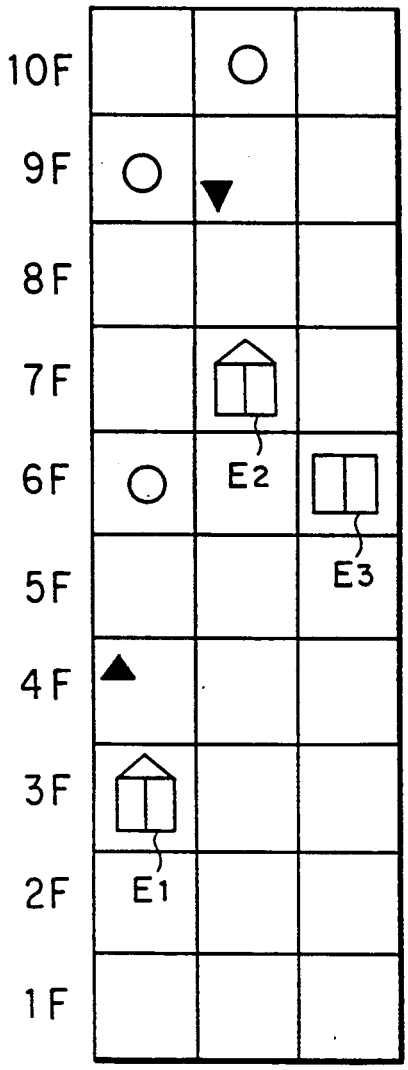
FIG. 2 is an explanatory view showing general operation an elevator system.

Assume, now, that three elevator cages $E_1$ to $E_3$ are installed in a ten-storied building as shown in FIG. 2, passengers in the elevator cage $E_1$ operate destination switches of sixth and ninth floors (Refer to marks "o"), a passenger in the elevator cage $E_2$ operates a destination switch of tenth floor, and passengers on fourth and ninth floors operate an up (Refer to a mark "▲") hall call switch and a down (Refer to a mark "▼") hall call switch.

In this case, the operation controller 3 inputs cage call information and elevator cage position information, etc. regarding the state at that time through the hall controller 1 and the cage controller 2, and assigns the elevator cages to the cage calls through the cage controller 2. More specifically, the elevator cage $E_1$ is ascending at the third floor, and has an assignment call for the up call (the mark "▲") on the fourth floor. The elevator cage $E_2$ is ascending at the seventh floor, and has an assignment call for the down call (the mark "▼") on the ninth floor. Accordingly, the elevator cage $E_1$ responds to the up call on the fourth floor, and then continues ascending. The elevator cage $E_2$ ascends to the tenth floor by responding to the destination call, and then descends by responding to the down call on the ninth floor.

On the other hand, the elevator cage $E_3$ responds to the previous final cage call, and then pauses on the sixth floor, thereby becoming a stand-by free cage. However, thereafter, since it is predicted that cage calls will be generated, for example, on the main floor of the first floor having a large amount of traffic, it is necessary to stand by the free cage $E_3$ at an optimum floor (e.g., first floor) to provide for the circumstances at that time.

Figure 3:
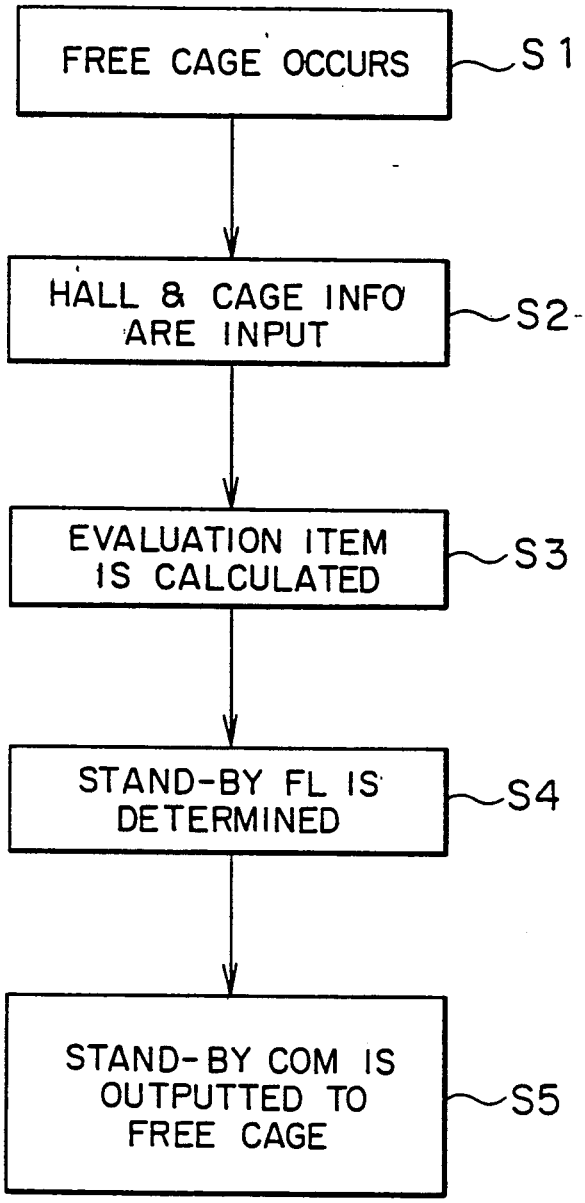
FIG. 3 is a flow chart showing the operation of the embodiment of the invention.

FIG. 3 is a flow chart showing the determining procedure of the optimum stand-by floor of the free cage.

If one free cage occurs as designated by $E_3$ in FIG. 2 (in step S1), the operation controller 3 inputs a detection signal representing the occurrence of the free cage $E_3$ to the stand-by control means 4, and obtains the operating states of the elevator cages $E_1$ to $E_3$ at that time and information regarding the cage calling states of the respective halls up to that time from the hall controller 1 and the cage controller 2, and transmits the information to the stand-by control means 4 (in step S2).

When the information input unit 5 in the stand-by control means 4 confirms the occurrence of the free cage $E_3$, the evaluation item arithmetic unit 6 calculates the evaluation item for the state that the free cage $E_3$ is stood by at a certain floor at that time on the basis of the fuzzy rules in the fuzzy rule group 9 (in step S3). There are as the evaluation items at that time:

i) the positions, advancing directions and operating states of the elevator cages $E_1$ to $E_3$, ii) the floor where the cage calls occur.

Then, the stand-by floor selector 7 determines the optimum stand-by floor on the basis of the calculated result (in step S4), and transmits it to the operation control means 3.

The operation control means 3 eventually outputs a stand-by command to the free cage $E_3$ through the cage controller 2 (in step S5).

Next, the detailed procedure of fuzzy inference in the step S3 will be described by referring to the explanatory view of FIG. 4 and the flow chart of FIG. 5.

Each fuzzy rule in the fuzzy rule group 9 described in IF-THEN format is composed of a know-how obtained from a simulation and/or past experiments, adaptability for a certain circumstance of each fuzzy rule is described in the IF section (condition section), and a procedure to be executed when the fuzzy rule is selected is described in the THEN section (executing section).

The adaptability of the fuzzy rule is defined by the correspondence of the subjective fuzziness like the fact that a certain amount is "large" or "small" to values of "0" to "1" (fuzzy amounts or membership values). The adaptability represented by the fuzzy amount (membership value) is obtained, concretely, by membership function LT, EQ or GT, etc. as shown in FIG. 4.

Figure 4:
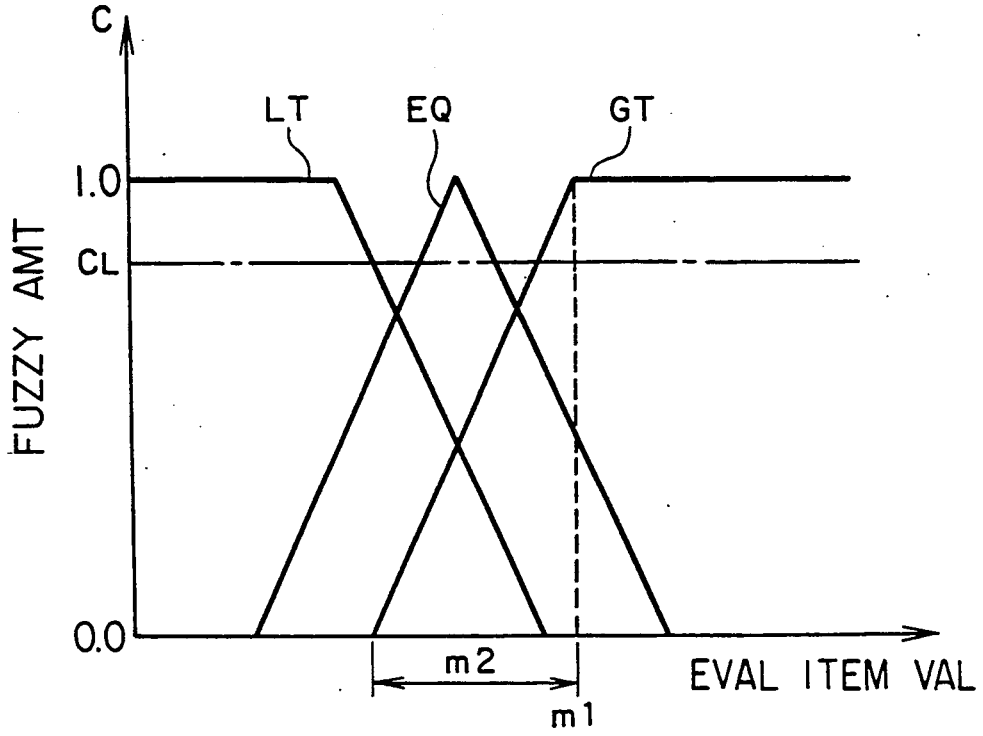
FIG. 4 is an explanatory view showing a membership function for obtaining a fuzzy amount.

In FIG. 4, the abscissa axis indicates an evaluation item value, and the membership functions LT, EQ and GT represent different evaluation references for different evaluation items. For example, if the evaluation item value is of the floor position of the elevator cage, the LT, EQ and GT respectively designate that the adaptability is maximum (fuzzy amount is "1") with respect to the position below a predetermined floor, the position of only the predetermined floor and the position above the predetermined floor. $C_L$ is of the lower limit value of the fuzzy amount C so as to determine the adaptability of the fuzzy rule, and $m_1$ and $m_2$ respectively represent, for example, a threshold value and an error range of the membership function GT.

On the other hand, the condition section and the executing section of a predetermined fuzzy rule ($i=1$) can be described as below.

"Rule 1"

Condition section (1) There is no elevator cage disposed near the main floor or having an assignment call.

(2) A stand-by elevator cage, i.e., a free cage exists at an upper storied floor from an intermediate floor.

Executing section

The free cage is moved to the main floor. In this manner, information knowledge is described as the fuzzy rule, thereby reflecting the human subjective theory.

Figure 5:
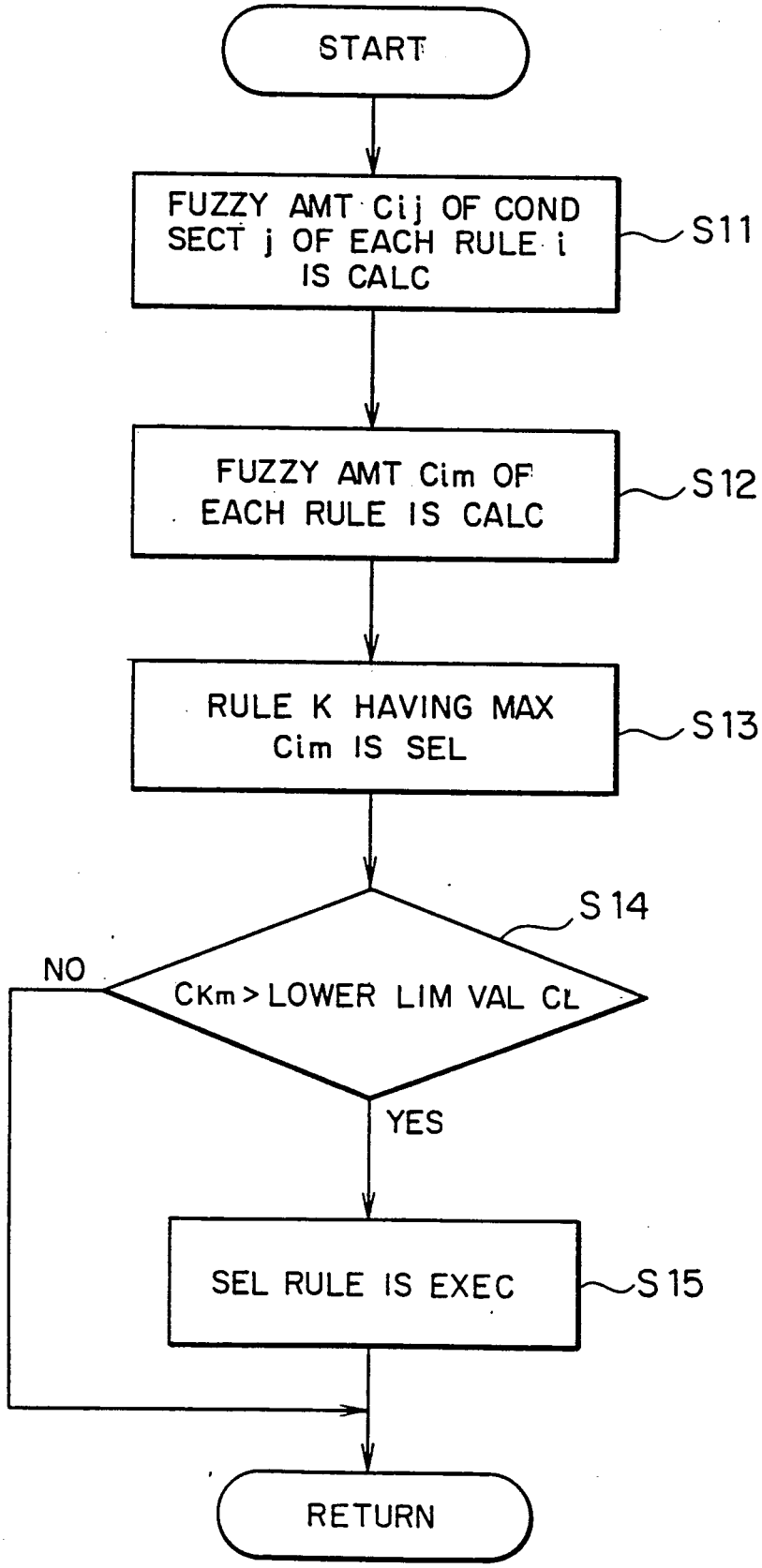
FIG. 5 is a flow chart showing in detail evaluation item calculating step in FIG. 3.

In FIG. 5, the fuzzy amount under the condition j of the fuzzy rule is designated by Cij, and the fuzzy amount Cij of each condition i in each fuzzy rule i is calculated (in step S11).

The step S11 will be described by assuming the concrete example in FIG. 2 and that the main floor is of a first floor. In order to first obtain the fuzzy amount under the condition (1) of the rule 1, the presence or absence of the elevator cage which satisfies at least one of the following conditions is determined.

(1*a*) The cage exists near the main floor.

(1*b*) The cage has a cage call on the main floor.

(1*c*) The cage has a hall call on the main floor.

Then, if such an elevator cage exists, the number "x" of such cages is obtained.

Figure 6A:
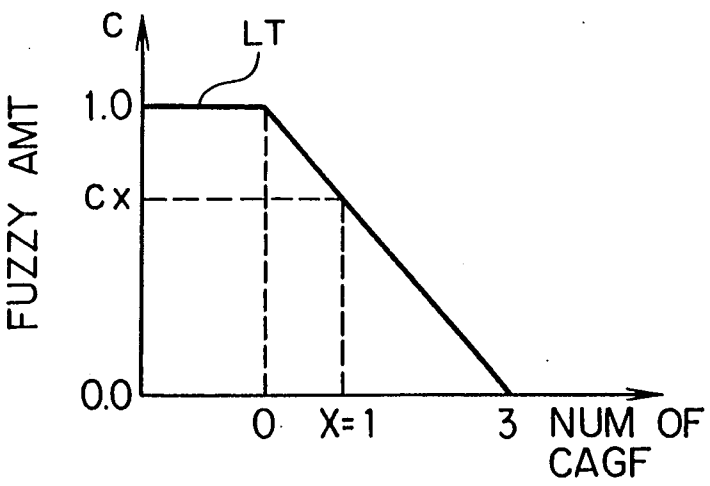
FIGS. 6(*a*) and 6(*b*) are explanatory views showing a membership function employed in an evaluation item calculating step.
Figure 6B:
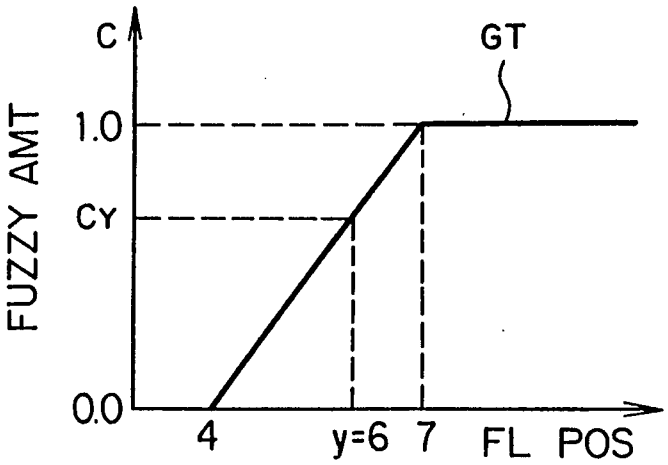

Here, assume that the passenger who gets on the elevator cage $E_2$ on ninth floor operates a destination (cage call) switch of the first floor. Then, the elevator cage $E_2$ is assigned to the cage call of the first floor, there is an elevator cage corresponding to the condition (1*b*), and $x=1$ is obtained. In this case, the membership function LT in which the evaluation item value (abscissa axis) represents the number of the cages as shown in FIG. 6(*a*) is designated corresponding to the condition section of the fuzzy rule 1, and the fuzzy amount Cx for the $x=1$ is obtained.

In this case, the threshold value is set to "0", and the maximum value of the error range is set to 3 (three elevator cages). In case of $x=0$, $Cx=1$, in case of $x=3$, $Cx=0$, and in case of $1 \leqq x \leqq 2$, the value of $1>Cx>0$ is obtained.

In order to obtain the fuzzy amount under the condition (2), the presence or absence of the free cage which becomes during standing-by or a stand-by state is determined, and if there is a free cage, its floor position (y) is obtained.

Here, since there is a free cage $E_3$ on the sixth floor, $y=6$ is obtained. Accordingly, as shown in FIG. 6(*b*), fuzzy amount Cy is obtained according to the membership function GT in which the intermediate floor reference ($=m_1$) is seventh floor, the error range ($m_2$) is 4-th to 7-th floors and the evaluation item value is of floor position. In this case, in case of $y \geqq 7$, $Cy=1$, in case of $y \leqq 4$, $Cy=0$, and in case of $5 \leqq y \leqq 6$, the value of the range of $0<Cy<1$ is obtained. The intermediate reference floor and the error range are initialized in response to the scale of the building, but can be suitably altered by the learning means 10.

If there are a plurality of stand-by free cages, the maximum fuzzy amount of the fuzzy amounts of the respective free cages is of a fuzzy amount Cy under the condition (2). If there is no free cage, $Cy=0$ is obtained.

As described above, the fuzzy amounts Cx and Cy obtained in the step S11 become fuzzy amount Cij under the condition j of a certain fuzzy rule 1. Similarly, the fuzzy amounts Cji of other fuzzy rule i can be obtained.

Then, the minimum fuzzy amount Cim of the fuzzy amount Cij under the condition i of one fuzzy rule i is calculated from the following equation:

$$Cim=\min(Ci_1, Ci_2, \ldots)$$

This Cim is of fuzzy amount of each fuzzy rule i (in step S12).

For example, if there is a free cage standing by at the intermediate or upper floor, the fuzzy amount Cy under the condition (2) becomes "1", but if there is an elevator cage which is moving towards the main floor, the fuzzy amount Cx under the condition (1) becomes a value near "0". Accordingly, the value (Cx) which is smaller than both is set as the fuzzy amount Cim of the fuzzy rule 1.

Next, a fuzzy rule k becoming maximum with respect to the fuzzy amounts Cim (its adaptability becomes maximum) is selected (in step S13), and whether or not the fuzzy amount Ckm of this fuzzy rule k exceeds a predetermined lower limit value $C_L$ is determined (in step S14). The lower limit value $C_L$ becoming a criterion is set to an arbitrary value from "0" to "1", such as approx. 0.8 to match the reference of the adaptability.

If $Ckm>C_L$ is determined, the executing section of the fuzzy rule k is executed (in step S15). For example, in case of the rule 1, the free cage $E_3$ is moved to the optimum stand-by floor at that time.

On the other hand, if $Ckm \leqq C_L$ is determined in the step S14, it is finished without executing the step S15. Accordingly, even if there is a fuzzy rule k having a maximum fuzzy amount Ckm, the free cage $E_3$ is not moved as long as the fuzzy amount Ckm does not satisfy a predetermined value (e.g., 0.8 or higher). Thus, the execution of the fuzzy rule k having low adaptability of the condition j can be prevented.

The procedure of the evaluation item calculation having the above steps S11 to S15 is repeated each time a free cage is generated, and whether or not the stand-by operation to the other floor should be executed is determined.

Further, various parameters used in the fuzzy rule, such as reference of upper floors, judgement of congested floor, etc. are suitably altered by a learning program (statistic data) in the learning means 10.

For example, if there is an expression "Move to congested floor at present time zone." in the execution section of a predetermined fuzzy rule, the congested floor is determined according to past operation history, and designated as the parameter of the fuzzy rule. More particularly, the number of hall calls in this time zone is statistically counted at each floor, and the floor having the largest number of hall calls in the past is determined as the congested floor. Accordingly, in the case as described above, the case that the first floor has statistically the most hall calls in this time zone is employed as an example. This main floor is varied in response to the time zone according to the statistic result. Thus, the criterion of determining the stand-by floor can be optimized in response to the traffic state of each floor varying from time to time in a building on a real time basis, and an elevator service having high flexibility and good efficiency can be performed.

On the other hand, assume that there is a fuzzy rule having a content as described below as another rule.

Condition section

There are a plurality of stand-by free cages, and the floor difference of the free cages falls within a predetermined value.

Executing section

One of the free cages is stood by to a main floor. In this case, when there is a large dispersion between the free cages at the respective floors, the stand-by operation is not executed, while when there are free cages concentrated within a predetermined floor difference, the stand-by operation is executed. Here, the learning means 10 sets the predetermined floor difference as a criterion of the dispersion of the cages as a parameter. For example, if it is predicted that the hall calls are concentrated at the main floor (stand-by floor), the predetermined value is increased, and if it is predicted that the hall calls are dispersed, the predetermined value is set to a small value. Thus, if the hall call distribution is concentrated, the criterion is restricted, and the stand-by operation is easily executed, while if it is dispersed, the criterion is widened, and the stand-by operation is scarcely executed.

The membership function EQ in FIG. 4 is applied with the evaluation item value (abscissa axis) as a floor position in the case that cage calls and hall calls are concentrated to the intermediate floor, such as the case that a conference is held on fifth floor.

In the embodiment described above, the case that three elevator cages $E_1$ to $E_3$ are installed in a ten-storied building has been described as an example. However, the present invention is not limited to the particular embodiment. For example, the present invention can also be applied to the group supervision of any arbitrary number of elevator cages in an arbitrarily storied building, and the equivalent advantages can be provided.

According to the present invention as described above, the elevator control apparatus comprises the operation control means for detecting the free elevator cage and suitably moving the free cage, the fuzzy rule base for storing a plurality of fuzzy rules of IF-THEN format written with conditions necessary to move the free cage and executing procedure, the learning means for altering the parameters of the fuzzy rules on the basis of information from the operation control means, and the stand-by control means for calculating fuzzy amounts of the fuzzy rules for the stand-by state of the free cage and selecting the fuzzy rule that the fuzzy amount exceeds the maximum and lower limiting value, thereby moving the free cage to the optimum stand-by floor at that time. Therefore, an elevator control apparatus which can serve corresponding to a variation in the traffic in a building is provided

What is claimed is:

1. An elevator control apparatus for group supervising a plurality of elevator cages comprising:

operation control means for detecting stand-by free elevator cage in a pause state and suitably moving the free cage, a fuzzy rule base for storing a plurality of fuzzy rules of IF-THEN format written with conditions necessary to move the free cage and executing procedure;

learning means for altering the parameters of said fuzzy rules on the basis of information from said operation control means; and stand-by control means for determining an optimum stand-by floor having an evaluation arithmetic unit operative to calculate fuzzy amounts of the fuzzy rules for the stand-by state of said free cage and to select a fuzzy rule that the fuzzy amount exceeds a maximum and lower limiting value, thus generating a signal directed to said operation control means and responsive to said selected fuzzy rule, for moving the free cages to the optimum stand-by floor,

2. An elevator control apparatus according to claim 1, wherein said stand-by control means generates a command signal to move said free cages when said free cages are concentrated within a predetermined floor difference.

3. An elevator apparatus according to claim 1, wherein said stand-by control means includes a stand-by floor selector, responsive to said fuzzy amount, for selecting the optimal stand-by floor in conformance with said fuzzy rules.

* * * * *